US005745925A

United States Patent [19]

Ghilardi et al.

[11] Patent Number: 5,745,925

[45] Date of Patent: May 5, 1998

[54] LEAD-CONTAINING GARMENT

[76] Inventors: Alfred Ghilardi, 34-B Elm St., Pepperell, Mass. 01463; Sean Paradis, 4 Vale St., Merrimac, Mass. 01860

[21] Appl. No.: 306,825

[22] Filed: Sep. 15, 1994

[51] Int. Cl.[6] ..... A41D 13/04; G21F 3/02

[52] U.S. Cl. ..... 2/457; 2/464; 2/467; 2/338; 2/48; 2/51; 250/516.1

[58] Field of Search ..... 2/2, 69, 69.5, 114, 2/47, 48, 51, 913, 915, 48.51, 338, 76, 457, 464, 467, 102, 108; 250/516.1, 519.1; 128/874

[56] References Cited

U.S. PATENT DOCUMENTS

| | | | |
|---|---|---|---|
| D. 080,474 | 2/1930 | Baker . | |
| D. 173,089 | 9/1954 | Reich | D3/26 |
| D. 253,558 | 12/1979 | Carter | D3/31 |
| D. 310,905 | 10/1990 | Marchione | D2/229 |
| 2,404,225 | 7/1946 | Green | 250/108 |
| 2,451,282 | 10/1948 | Feibel | 250/108 |
| 3,093,829 | 6/1963 | Maine | 250/516.1 |
| 3,160,143 | 12/1964 | Gray | 2/913 |
| 3,823,417 | 7/1974 | Cluckey | 2/91 |
| 3,996,620 | 12/1976 | Maine | 2/2 |
| 4,040,124 | 8/1977 | Zoephel | 2/51 |
| 4,196,355 | 4/1980 | Maine | 250/516 |
| 4,266,299 | 5/1981 | Beal | 2/46 |
| 4,413,357 | 11/1983 | Sacks | 2/2.5 |
| 4,417,146 | 11/1983 | Herbert | 250/516.1 |
| 4,441,025 | 4/1984 | McCoy, Jr. | 250/516.1 |
| 4,524,463 | 6/1985 | Ogden | 2/105 |
| 4,527,288 | 7/1985 | Hoffman et al. | 2/48 |
| 4,611,353 | 9/1986 | Als et al. | 2/69 |
| 4,766,608 | 8/1988 | Cusick et al. | 2/2 |
| 4,769,855 | 9/1988 | Tsai | 2/114 |
| 4,843,641 | 7/1989 | Cusick et al. | 2/2 |
| 4,873,725 | 10/1989 | Mitchell | 2/48 |
| 4,924,103 | 5/1990 | Stein et al. | 250/516.1 |
| 4,975,984 | 12/1990 | Sting | 2/114 |
| 5,015,865 | 5/1991 | Sayers | 250/516.1 |
| 5,028,796 | 7/1991 | Swartz | 250/516.1 |
| 5,150,477 | 9/1992 | Elberson et al. | 2/114 |
| 5,267,352 | 12/1993 | Rodarmel | 2/114 |
| 5,274,851 | 1/1994 | Simpkins, Sr. et al. | 2/102 |
| 5,274,852 | 1/1994 | Hogan | 2/114 |

*Primary Examiner*—Amy B. Vanatta
*Attorney, Agent, or Firm*—Fish & Richardson P.C.

[57] ABSTRACT

A radiation-attenuating garment which includes a main body portion covering the chest and thighs of a user, and a pair of flexible securing straps designed to wrap snugly around the user's lower back and abdomen to form a support segment. During use, variable degrees of lumbar/abdominal compression and support are obtained by circumferentially adjusting the support segment. This additionally results in a transference of the weight of the garment from the shoulders to the hips.

20 Claims, 3 Drawing Sheets

LEAD-CONTAINING GARMENT

BACKGROUND

This invention relates to protective radiation-attenuating garments.

Protective garments capable of attenuating harmful x-ray radiation are typically worn by doctors, dentists, x-ray technicians, and others who may be exposed to x-ray radiation during medical or dental examinations. Such garments typically contain a lining composed of an x-ray attenuating material (e.g., lead or lead alloys) which protects the user. Unfortunately, these materials add weight to the garments, making them heavy and uncomfortable to wear. Shoulder straps which drape over the shoulders of the user are usually required to support the weight of the garment. Enhanced support may also be provided by straps which wrap around the waist of the user, thereby allowing the weight of the garment to be broadly and evenly distributed across the shoulders, chest, back and hips.

U.S. Pat. No. 5,274,851 describes a radiation-attenuating garment which contains lead panels and a pair of resilient bands which extend across the back of a wearer. When the garment is worn, the ends of the bands are attached at a fixed position in the front portion of the garment, allowing the weight of the lead (normally carried by the shoulders) to be distributed across the back.

SUMMARY

Accordingly, in one aspect, the invention provides an x-ray-attenuating garment including a front section containing an x-ray-attenuating material and a surrounding, supporting material. The garment also includes a circumferentially adjustable lumbar/abdominal support segment containing an abdominal panel positioned to extend circumferentially across the abdomen and vertically to cover a portion of the abdomen between the hips and thorax, and a lumbar panel, connected to either end of the abdominal panel, which is positioned to extend circumferentially across the lumbar region. The lumbar and abdominal panels are configured to be broad enough so that circumferential adjustment of the support segment exerts tension on the panels, thereby providing an adjustable compressive force to support the lumbar/abdominal regions. For example, the abdominal panel covers a substantial part of the region between the hips and thorax.

The front panel also includes two openings to provide clearance for the user's arms, and a securing patch located on a front surface of the panel near the abdominal region of the user. The abdominal and lumbar panels are formed by a first and second strap which are connected when said garment is worn. The securing straps contain an elastic region and a wide end portion, and may be attached to the front panel proximate to the openings.

The first strap includes a securing patch located on its front and back surfaces, while the second strap includes a securing patch located on its back surface. The straps are configured to cross or extend proximate to the lumbar region of the user, independently wrap around the user's hips, cross proximate to the abdominal region, and attach to the securing patch on the front panel by way of the securing patches located on the wide end portions. This configuration secures the apron to the user, and provides an adjustable compressive force to the lumbar/abdominal regions, while allowing a portion of the weight of the apron to be supported by the hips of the user.

In another aspect, the front section of the garment is configured to wrap around the torso of said user. In this aspect, the support segment is configured to wrap circumferentially around the lumbar and abdominal regions of the user, and the first and second straps are preferably connected to each other and to a back portion of the front segment.

The garment thus provides a supportive function while reducing the amount of strain and fatigue normally associated with wearing lead-containing garments. In addition, when secured tightly to the waist of the user, the garment facilitates proper lifting techniques, and may prevent injury to the user's lower back and abdomen. The provision of the relatively broad circumferentially adjustable abdominal panel is particularly important for proper abdominal/lumbar support.

In preferred embodiments, the wide end portions of the first and second straps are configured to provide support to the abdominal region of the user; preferably, these portions have a width of between 4.0 and 8.0 inches, inclusive.

In other preferred embodiments, the securing patch located on the back surface of the end portion of the first strap is configured to attach to the securing patch located on the front surface of the front panel. Additionally, the securing patch located on the back surface of the end portion of the second strap is configured to attach to the securing patch located on the front surface of the end portion of the first strap. Preferably, each of the securing patches VELCRO brand hook-and-loop fasteners are patches.

In other preferred embodiments, the first and second straps are configured to be adjusted horizontally with respect to the abdominal region of the user, thereby providing an adjustable compressional force to the lumbar/abdominal region.

In still other preferred embodiments, the x-ray-attenuating material consists essentially of lead or a lead-based alloy, and the surrounding, supporting material consists essentially of nylon.

DETAILED DESCRIPTION

Figure 1A:
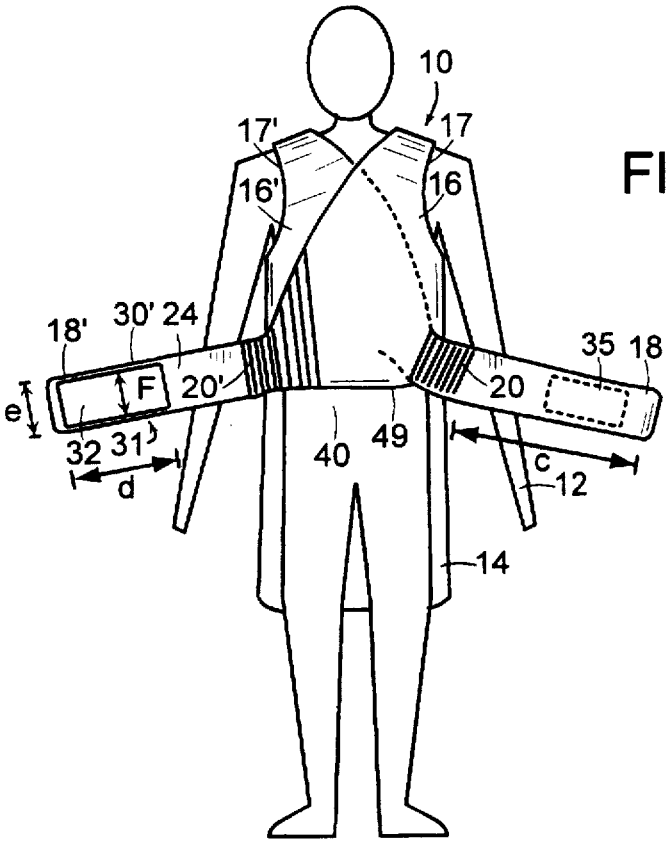
FIGS. 1A, 1B, 2A, and 2B are, respectively, a back view of the open-back lead apron with extended securing straps, a front view of the open-back lead apron with fastened securing straps, a back view of the closed-back lead coat with fastened securing straps, and a front view of the closed-back lead coat with extended securing straps.

Referring to FIGS. 1A, 1B, and 3A–3E, an open-back apron 10 includes a front section 14 containing panels of lead or a lead-based alloy surrounded by a high-strength fiber, such as nylon; when worn by a user 12, these panels allow the chest, abdomen, and thighs to be protected from harmful x-ray radiation. Belt loops 36, 36' and a VELCRO brand hook-and-loop fasteners patch 34 are attached, respectively, to the sides and face of the front section 14 in order to support and secure two securing straps 18, 18', each of which contains separate resilient elastic regions 20, 20' (made, e.g., of neoprene rubber) and patches of VELCRO brand hook-and-loop fasteners 32, 35 located on the strap end portions. Each strap 18 (18') is adjacent to a single armhole 17 (17') and is individually attached to two separate back panels 16, 16' designed to cover the upper back of the user 12.

In order to attach the apron 10, the user's arms are inserted into the armholes 17, 17', allowing the apron to be draped on the shoulders and the back panels 16, 16' to contact the user's upper back region. The securing strap 18' containing VELCRO brand hook-and-loop fasteners patches 31, 32 on the front 24 and back 30 faces is then extended and fed through the corresponding belt loop 36', and then attached with the VELCRO brand hook-and-loop fasteners patch 31 (containing loops or hooks) on the back face 30 of the strap to the patch 34 in the front section 14 of the apron 10. By wrapping the strap with the desired amount of tension, a variable compressional force can be applied to the user's lumbar/abdominal region. Once the first securing strap is attached, the second strap 18 is extended so that it crosses the first strap proximate to the user's lower back, and is then fed through the corresponding belt loop 36, pulled to the desired tension, and secured to an exposed patch 32 on the back side 24 of the secured arm 18', thereby allowing the apron 10 to be secured and the appropriate compressional force to be applied to the lumbar/abdominal region of the user 12. In all embodiments, the patches containing either loops and hooks may be interchanged.

The combination of the tightened securing straps forms a circumferentially adjustable lumbar/abdominal support segment which includes an abdominal panel 47 and a lumbar panel 49. The abdominal panel 47 extends circumferentially across the abdomen and vertically to cover a portion of the abdomen between the hips and thorax. The lumbar panel is connected to either end of the abdominal panel, and is positioned to extend circumferentially across the lumbar region of the user. Both panels are configured such that circumferential adjustment of the support segment exerts tension on the panels, thereby providing an adjustable compressive force to support the lumbar/abdominal regions.

Once secured, the compressional force induced by the support segment allows the apron 10 to be uplifted slightly, thus reducing the weight supported by the user's shoulders. Additionally, the tension of the segment provides variable support for the lower back to protect it from injury. The widths of the end portions of the straps are chosen to provide support to the user's abdominal region. Furthermore, the adjustable straps allow the apron 10 to conform to the different waist sizes different users.

Figure 1B:
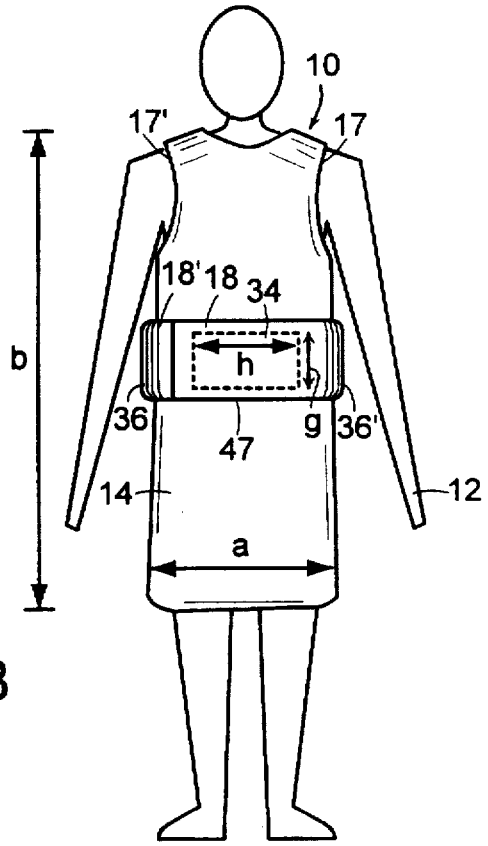

The front section 14 of the apron 10 preferably contains at least one lead panel having a thickness of between 0.2 and 0.5 mm, depending on the desired degree of radiation attenuation; the total weight of the apron varies from about 10 to 20 lbs. For maximum effectiveness and comfort, the apron should be tailored to the dimensions of the particular user, although, as mentioned herein, the adjustable straps allow a single apron to fit users of different sizes. Typical dimensions of the apron illustrated in FIGS. 1A and 1B are listed in Table 1, below.

TABLE 1

Typical Dimensions of the Lead Apron

| Component | Dimension (inches) |
|---|---|
| a | 24.0 |
| b | 35.0 |
| c | 25.5 |
| d | 17.0 |
| e | 6.0 |
| f | 4.0 |
| g | 4.0 |
| h | 22.25 |

Figure 2A:
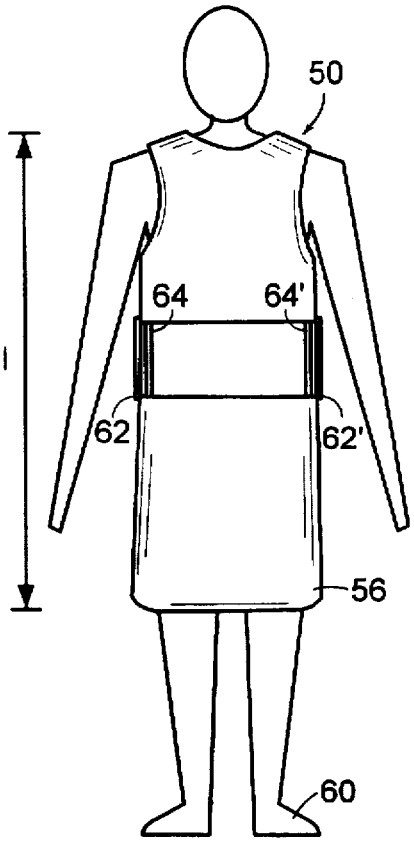
Figure 2B:
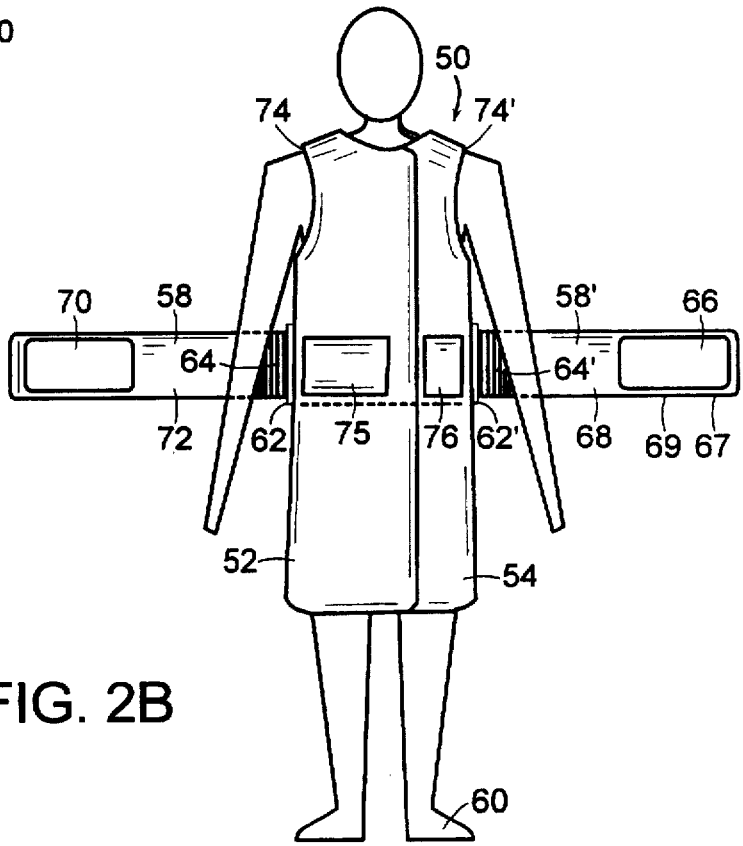
Figure 3A:
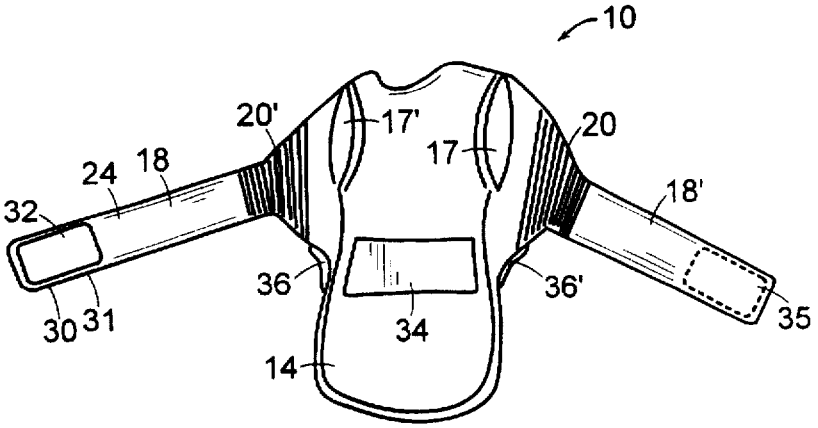
FIGS. 3A–3E are front views of the open-back lead apron at different stages of application.
Figure 3B:
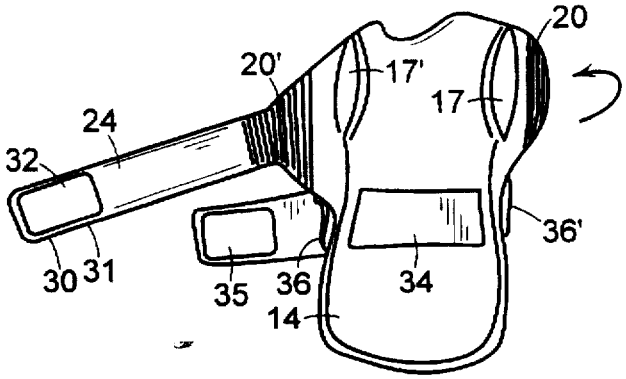
Figure 3C:
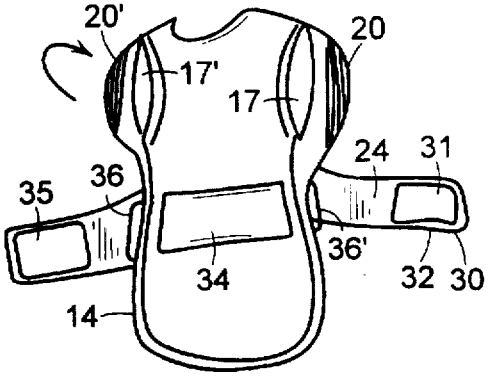
Figure 3D:
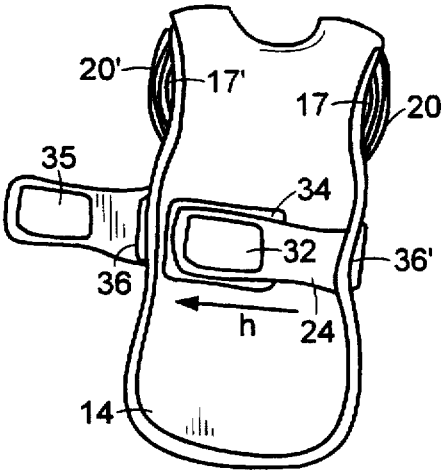
Figure 3E:
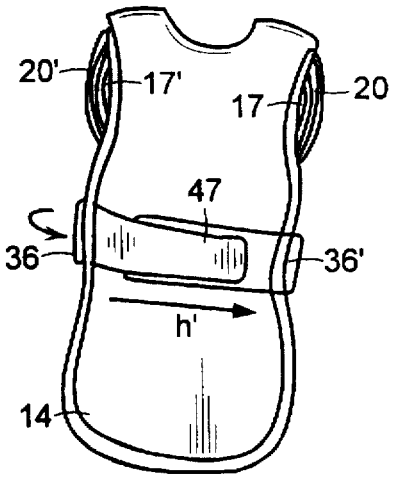

Referring now to FIGS. 2A and 2B, in another aspect, a closed-back lead coat 50 contains a first front section 52 which folds over on a second front section 54, each of which has a length (indicated by the letter 1 in the figure) roughly equivalent to a rear panel 56. The combination of the front and rear panels allows the entire torso and upper thigh regions of the user 60 to be protected from x-ray radiation. Belt loops 62, 62' are attached, respectively, to the sides of the two front panels to support and secure the securing straps 58, 58' connected to the lower back region of the back panel 56. In preferred embodiments, the straps 58, 58' are connected in this region.

As with the apron, each securing strap 58, 58' contains separate resilient elastic regions 64, 64' which are conformable to the users body shape; these elastic regions allow the straps to be tightly secured around the user's waist. In addition, the straps have wide end portions which allow the abdominal region of the user to be adequately supported. The first securing strap 58' includes two patches 66, 67 (containing either hooks or loops) located opposite to each other on the front 68 and back 69 surfaces of the end portion of the strap. The second securing strap 58 contains a single patch 70 located on the front surface 72 of the end portion of strap. As before, patches containing either loops and hooks may be interchanged.

In order to attach the coat 50 to the user 60, the user's arms are inserted into armholes 74, 74', and the first front section 52 is folded over the second front section 54 to enclose the user 60 in the coat 50. The second securing strap 58' is then extended, pulled to the desired tension, fed through the belt loop 64', and attached (by way of the VELCRO brand hook-and-loop fasteners patch 66) to two VELCRO brand hook-and-loop fasteners patches 75, 76 located, respectively, on the two front sections 52, 54 of the coat. The procedure is repeated for the first securing strap, with the VELCRO brand hook-and-loop fasteners patch 70 affixing to the VELCRO brand hook-and-loop fasteners patch 67 located on the back surface 69 of the second securing strap.

As before, the combination of the tightened securing straps forms a circumferentially adjustable lumbar/abdominal support segment which includes an abdominal panel (not shown in the figure) and a lumbar panel 79. The abdominal panel extends circumferentially across the abdomen and vertically to cover a portion of the abdomen. The lumbar panel 79 is connected to either end of the abdominal panel, and is positioned to extend circumferentially across the lumbar region of the user.

When tightened in this fashion around the lumbar/abdominal region of the user 50, the straps 58, 58' allow circumferential adjustment of the support segment, and provide a compressional force which supports the lower back and abdomen of the user. The support segment additionally allows the weight of the apron to be distributed between the shoulders and the hips.

Referring again to FIGS. 3A–3E, the degree of circumferential adjustment and compressional force induced in the lumbar/abdominal region of the user can be adjusted by varying the horizontal position (indicated by arrows h and h') at which the patches 31, 32, and 35 located on the strap end portions are connected to the front section 14 of the apron 10. Pulling the straps in the horizontal direction along the direction indicated by the arrow increases the tension of the straps, thereby increasing the compressional force and support applied to the lumbar and abdominal regions. An increase in tension also allows a greater fraction of the lead apron's weight to be supported by the hips, rather than the shoulders, of a user.

Other embodiments are within the scope of the following claims.

What is claimed is:

1. An x-ray-attenuating garment comprising a front section containing an x-ray-attenuating material and a surrounding, supporting material, said garment further comprising:

an adjustable lumbar/abdominal support segment comprising an abdominal panel positioned to extend across the abdomen of a user and vertically to cover a portion of the abdomen between the hips and thorax, and a lumbar panel, connected to either end of said abdominal panel, and positioned to extend across the lumbar region of a user, said lumbar and abdominal panels being configured together to form a girdle extending entirely around the user's abdomen and lumbar regions, said girdle being circumferentially adjustable to exert substantial circumferential tension and support across the user's abdominal and lumbar regions, thereby providing an adjustable compressive force to support the lumbar/abdominal regions.

2. The garment of claim 1, further comprising two openings to provide clearance for said user's arms, and a securing patch located on a front surface of said section and configured to attach to said abdominal panel.

3. The garment of claim 2, wherein said abdominal and lumbar panels are formed by a first and second strap which are connected when said garment is worn.

4. The garment of claim 3, wherein said first strap is attached to said front section proximate to a first opening and contains an elastic region and a wide end portion which includes a securing patch located on its front and back surfaces, and said second strap is attached to said front section proximate to a second opening and contains an elastic region and a wide end portion which includes a securing patch located on its back surface, said straps, when said garment is worn by said user, being configured to cross proximate to said lumbar region of said user, independently wrap around said user's hips, cross proximate to said abdominal region, and attach to said securing patch on said front section by way of said securing patches located on said wide end portions to form said abdominal and lumbar panels.

5. The garment of claim 4, wherein said wide end portions have a width of between 4.0 and 8.0 inches, inclusive.

6. The garment of claim 4, wherein each of said securing patches are hook-and-loop fastening patches.

7. The garment of claim 4, wherein said securing patch located on said back surface of said end portion of said first strap is configured to attach to said securing patch located on said front surface of said front section, and said securing patch located on said back surface of said end portion of said second strap is configured to attach to said securing patch located on said front surface of said end portion of said first strap.

8. The garment of claim 7, wherein said first and second straps are configured to be adjusted circumferentially with respect to said abdominal region of said user.

9. The garment of claim 1, wherein said x-ray-attenuating material consists essentially of lead or a lead-based alloy.

10. The garment of claim 9, wherein said surrounding, supporting material consists essentially of nylon.

11. The garment of claim 2, wherein said front section is configured to wrap around the torso of said user.

12. The garment of claim 11, wherein said support segment is configured to wrap circumferentially around the lumbar and abdominal regions of the user.

13. The garment of claim 12, wherein said abdominal and lumbar panels are formed by a first and second strap, each being connected to said front section, and being connected together when said garment is worn.

14. The garment of claim 13, wherein said first strap contains an elastic region and a wide end portion which includes a securing patch located on its front and back surfaces, and said second strap contains an elastic region and a wide end portion which includes a securing patch located on its back surface, said straps, when said garment is worn by said user, being configured to extend across said lumbar region of said user, independently wrap around said user's hips, cross proximate to said abdominal region, and attach to said securing patch on said front section by way of said securing patches located on said wide end portions to form said abdominal and lumbar panels.

15. The garment of claim 14, wherein said wide end portions have a width of between 4.0 and 8.0 inches, inclusive.

16. The garment of claim 14, wherein each of said securing patches are hook-and-loop fastening patches.

17. The garment of claim 14, wherein said securing patch located on said back surface of said end portion of said first strap is configured to attach to said securing patch located on said front surface of said front section, and said securing patch located on said back surface of said end portion of said second strap is configured to attach to said securing patch located on said front surface of said end portion of said first strap.

18. The garment of claim 17, wherein said first and second straps are configured to be adjusted circumferentially with respect to said abdominal region of said user.

19. The garment of claim 11, wherein said x-ray-attenuating material consists essentially of lead or a lead-based alloy.

20. The garment of claim 11, wherein said surrounding, supporting material consists essentially of nylon.

* * * * *